US011777247B2

(12) United States Patent
Spataru et al.

(10) Patent No.: US 11,777,247 B2
(45) Date of Patent: Oct. 3, 2023

(54) HOUSING ASSEMBLY FOR A CONNECTOR, METHOD FOR RELEASING A CONNECTION BETWEEN A CONNECTOR AND A MATING CONNECTOR

(71) Applicant: TE Connectivity Germany GmbH, Bensheim (DE)

(72) Inventors: Florin Spataru, Bensheim (DE); Bernd Leonhardt, Bensheim (DE); Michael Schall, Bensheim (DE)

(73) Assignee: TE Connectivity Germany GmbH, Bensheim (DE)

( * ) Notice: Subject to any disclaimer, the term of this patent is extended or adjusted under 35 U.S.C. 154(b) by 0 days.

(21) Appl. No.: 17/190,484

(22) Filed: Mar. 3, 2021

(65) Prior Publication Data

US 2021/0281006 A1 Sep. 9, 2021

(30) Foreign Application Priority Data

Mar. 3, 2020 (DE) ..... 10 2020 202 727.7

(51) Int. Cl.
*H01R 13/506* (2006.01)
*H01R 13/508* (2006.01)

(52) U.S. Cl.
CPC ..... *H01R 13/506* (2013.01); *H01R 13/508* (2013.01)

(58) Field of Classification Search
None
See application file for complete search history.

(56) References Cited

U.S. PATENT DOCUMENTS 7,137,844 B2 * 11/2006 Flowers ..... H01R 13/6295 439/372
2015/0155652 A1 * 6/2015 Ender ..... H01R 13/629 403/376
2019/0334308 A1 * 10/2019 Kopacek ..... G02B 6/3898
2020/0036134 A1 1/2020 Loas
2021/0083427 A1 * 3/2021 Kim ..... H01R 13/62955
2021/0288440 A1 * 9/2021 Giesbrecht ..... H01R 13/62938

FOREIGN PATENT DOCUMENTS

JP 2002-203 639 A 7/2019
KR 10 2014 0 064 289 A 5/2014
KR 10 1 479 054 B1 1/2015
KR 20210033153 A * 9/2018 ..... H01R 13/629

OTHER PUBLICATIONS

German Office Action, dated Jun. 30, 2021, 6 pages.
Extended European Search Report, dated Jul. 16, 2021, 24 pages.
Examination Report from the European Patent Office dated Jun. 23, 2023, corresponding to Application No. 21 160 222.2-1201, 9 pages.

* cited by examiner

*Primary Examiner* — Oscar C Jimenez
(74) *Attorney, Agent, or Firm* — Barley Snyder

(57) ABSTRACT

A housing assembly for a connector includes a securing mechanism for securing the connector to a mating connector in a securing position, and a locking mechanism. The locking mechanism in a locking position locks the securing mechanism in the securing position. The locking mechanism is latchable in a holding position in which the securing mechanism can be moved out of the securing position.

11 Claims, 14 Drawing Sheets

HOUSING ASSEMBLY FOR A CONNECTOR, METHOD FOR RELEASING A CONNECTION BETWEEN A CONNECTOR AND A MATING CONNECTOR

CROSS-REFERENCE TO RELATED APPLICATIONS

This application claims priority under 35 U.S.C. § 119 to German Patent Application No. DE 10 2020 202 727.7, filed on Mar. 3, 2020.

FIELD OF THE INVENTION

The invention relates to a connector and, more particularly, to a housing assembly for a connector.

BACKGROUND

In the prior art, releasing a connector from a mating connector is often complex. Therefore, there is a need for a solution that enables the simple release of a connector.

SUMMARY

A housing assembly for a connector includes a securing mechanism for securing the connector to a mating connector in a securing position, and a locking mechanism. The locking mechanism in a locking position locks the securing mechanism in the securing position. The locking mechanism is latchable in a holding position in which the securing mechanism can be moved out of the securing position.

BRIEF DESCRIPTION OF THE DRAWINGS

The invention will now be described by way of example with reference to the accompanying Figures, of which.

DETAILED DESCRIPTION OF THE EMBODIMENTS

Figure 1:
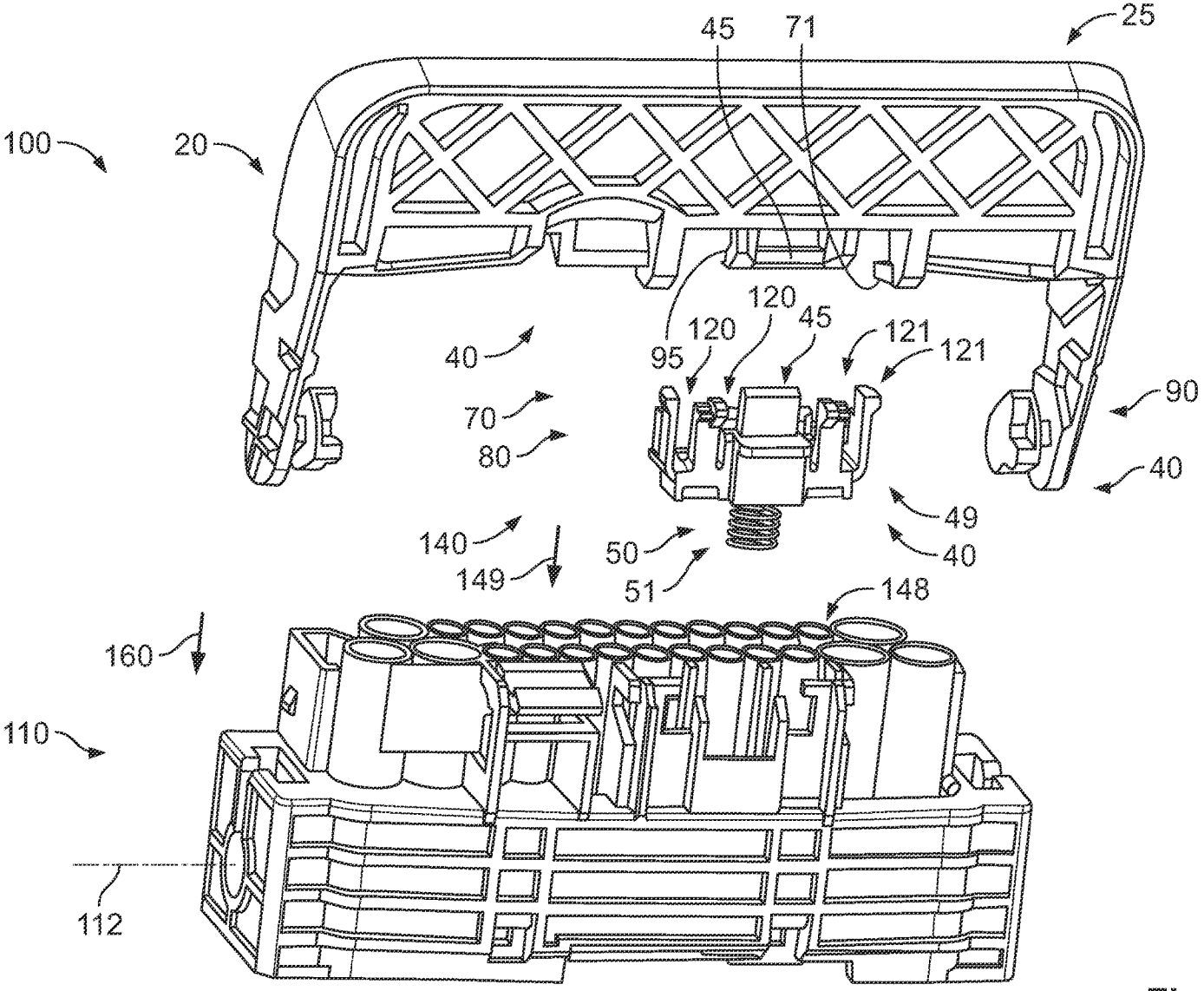
FIG. 1 shows a schematic perspective view of an embodiment of a housing assembly.

Technical solutions of the present disclosure will be described hereinafter in detail through embodiments and with reference to the attached drawings. In the specification, the same or the like reference numerals refer to the same or the like elements. The illustration of the embodiments of the present disclosure made with reference to the attached drawings is aimed to explain the general inventive concept of the present disclosure, not to be construed as a limitation of the present disclosure.

In addition, in the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawings.

In the following, the invention shall be described by way of example in detail with reference to the drawings using advantageous configurations. The advantageous further developments and configurations illustrated there are each independent of each other and can be combined with one another, in dependence of the requirement of the application.

Referring now to the figures, a housing assembly 100 for a connector is shown in FIG. 1 in an exploded view. In addition to the elements shown in FIG. 1, i.e. in particular a housing 110, a catch 49, a drive mechanism 50, and a securing mechanism 20, a connector can comprise further elements such as contact elements in the interior for establishing electrical contact with a mating connector.

Securing mechanism 20 can include a lever 25. This allows the actuation to be carried out easily and with little force. Lever 25 can be attached to housing 110 and rotated there about an axis 112. Securing mechanism 20, which secures the connector on the mating connector, for example, by way of a positive fit engagement, can be moved to a securing position 21 in which the connector is secured to the mating connector or can be moved out of securing position 21, for example, to a release position. Securing mechanism 20 can also fulfill further functions. For example, it can press the connector and the mating connector together when it is moved to the securing position. For this purpose, securing mechanism 20 can have contact surfaces running spiral-shaped about axis 112.

Catch 49 is part of a locking mechanism 40 which in a locking position 41 can lock securing mechanism 20 in securing position 21, so that the latter cannot be moved out of securing position 21. Locking mechanism 40 can be moved out of locking position 41, so that securing mechanism 20 can then be moved out of securing position 21.

In order to enable such a release in a simple manner, locking mechanism 40 can be held in a holding position 42. For example, it can be actuated manually by a user on an actuation section 48 in that the user presses catch 49 along a direction of motion 149 in the direction toward housing 110 and against the drive force of a drive mechanism 50. The housing 110 has a plurality of guide elements 148 guiding the direction of motion 149. In an embodiment, as shown in FIG. 1, the drive mechanism 50 is a spring element 51. As a result, a stop surface 45 on the catch disengages from a corresponding stop surface 45 on lever 25.

Figure 2:
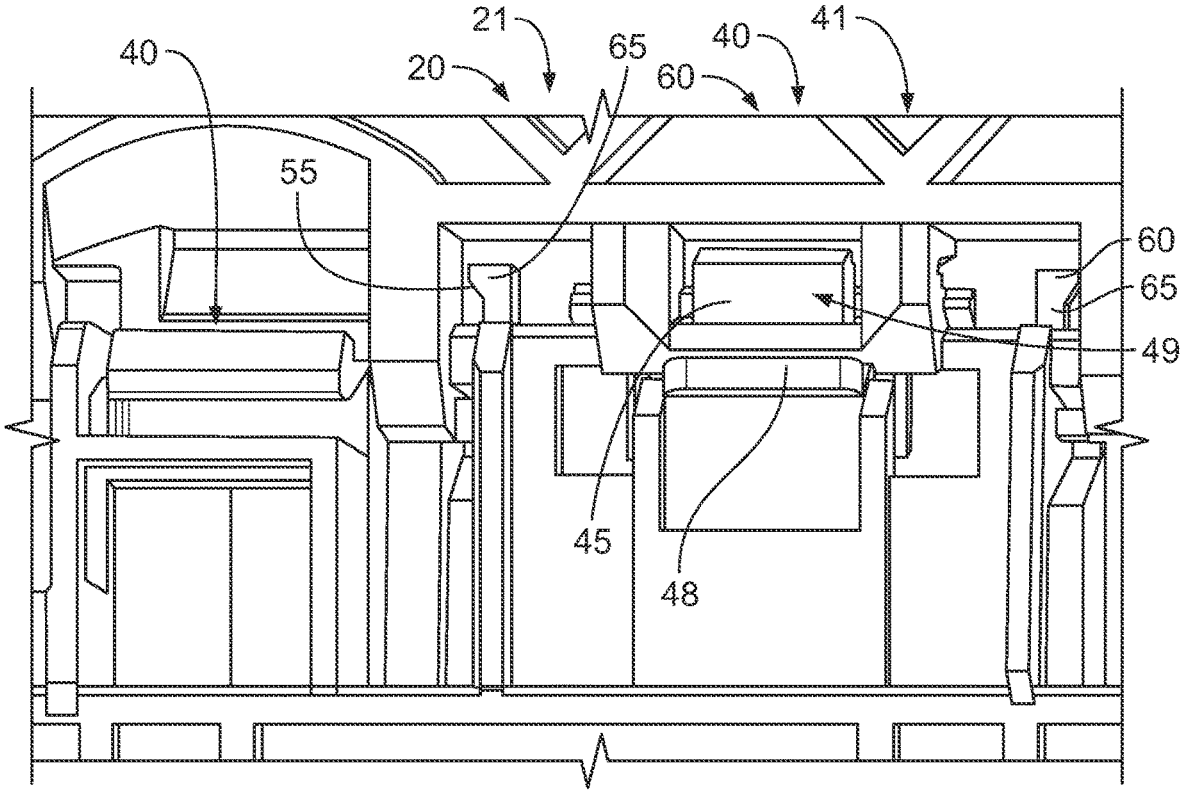
FIG. 2 shows a schematic detailed view of the embodiment from FIG. 1 in a locking position.
Figure 3:
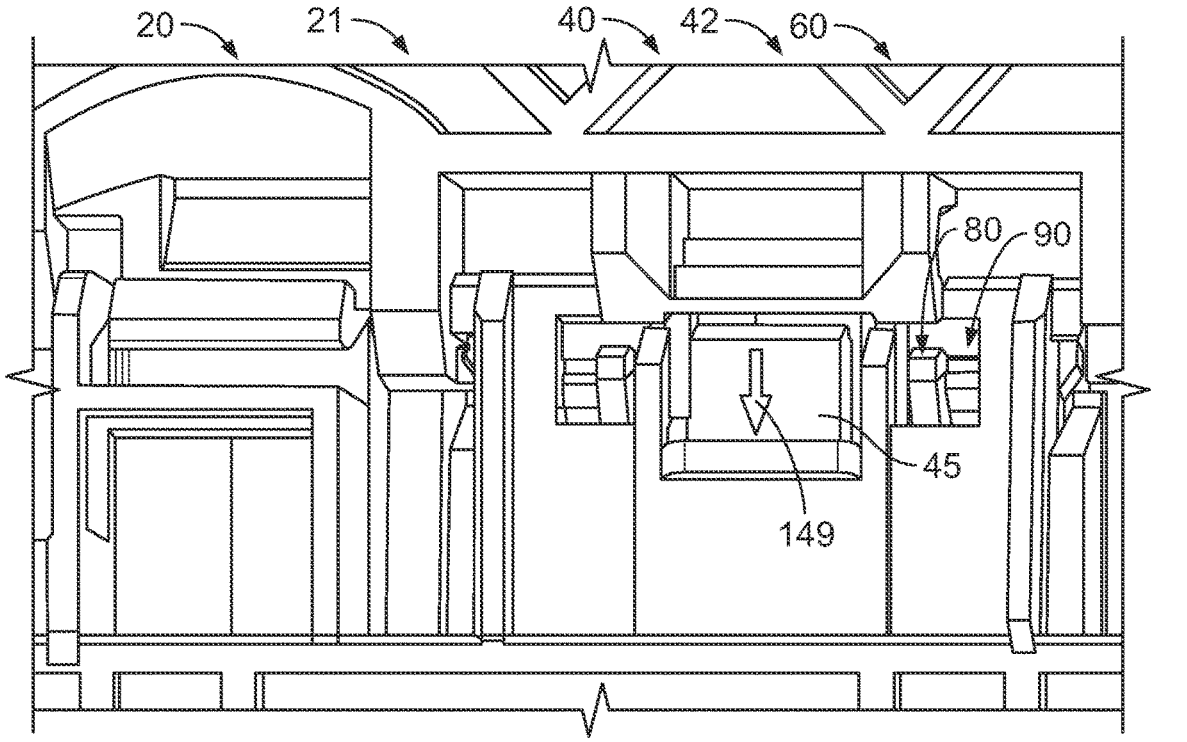
FIG. 3 shows a schematic detailed view of the embodiment from FIG. 1 in a holding position.
Figure 4:
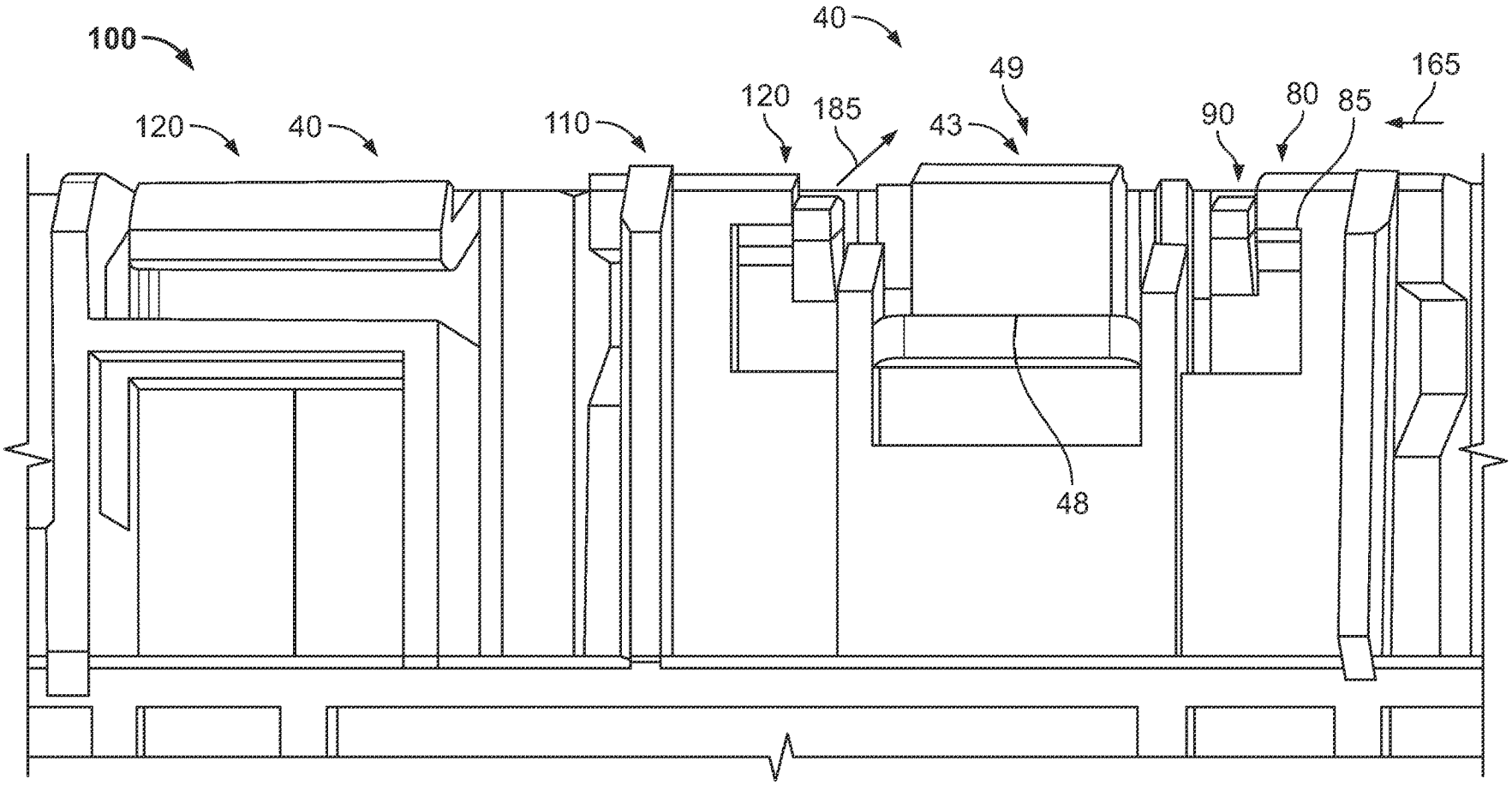
FIG. 4 shows a schematic detailed view of the embodiment from FIG. 1 in a pre-latched position.
Figure 5C:
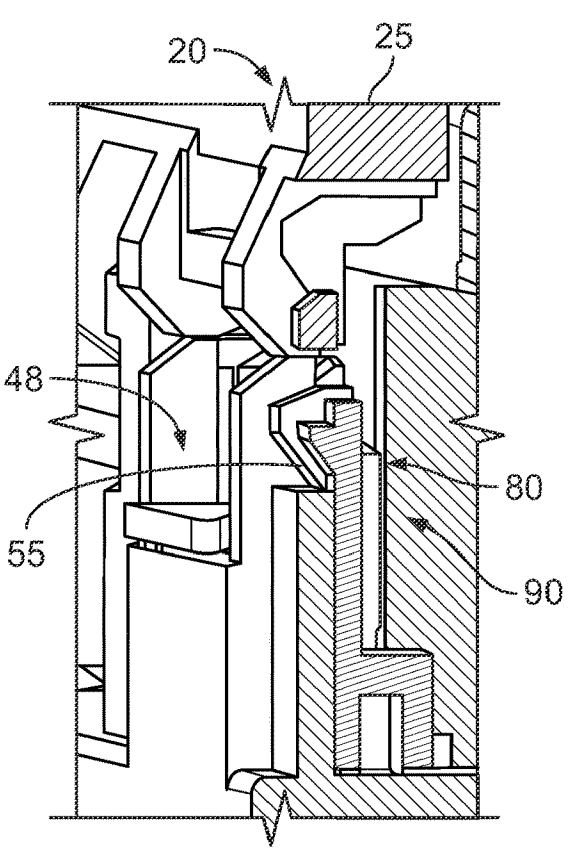
FIGS. 5A-5E show various schematic representations of the securing position.
Figure 5B:
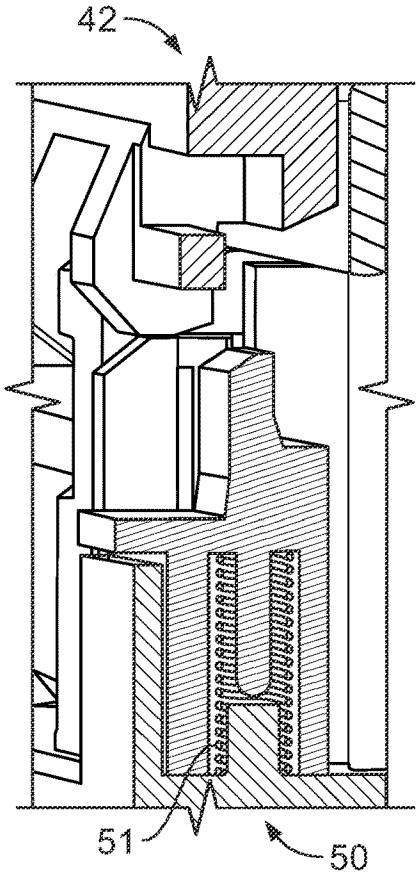
Figure 5A:
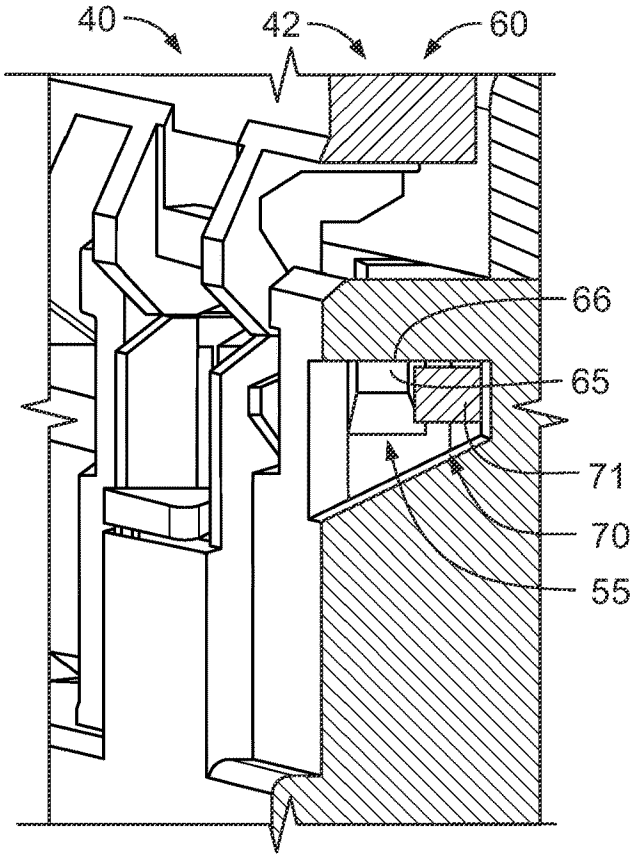
Figure 5D:
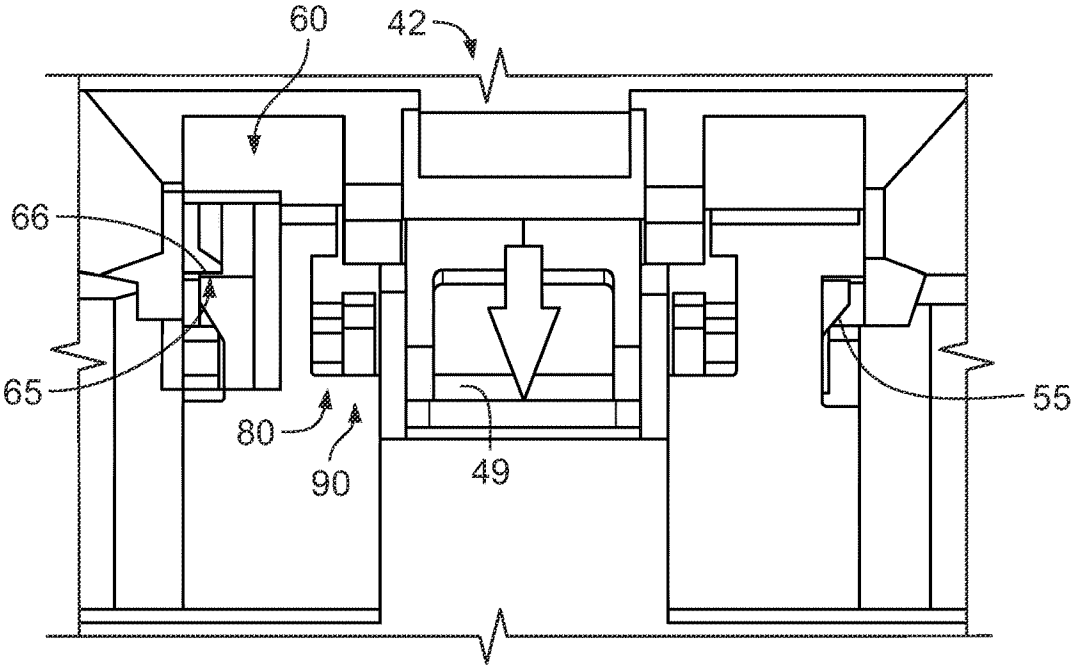
Figure 5E:
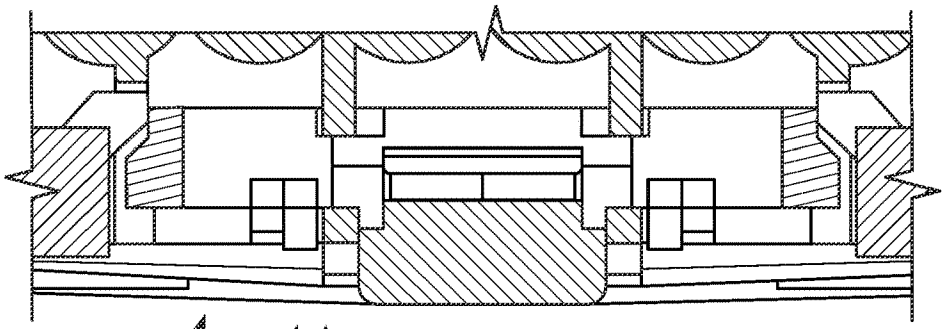
Figure 6C:
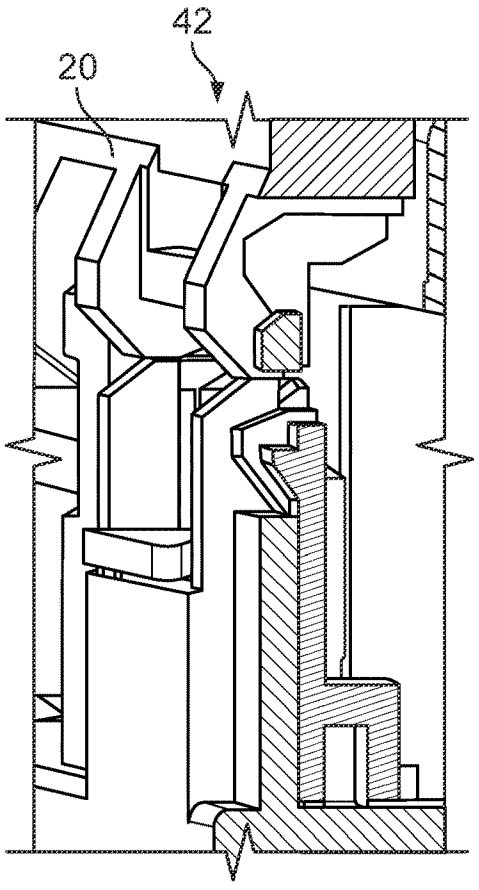
FIGS. 6A-6E show various schematic representations of the holding position.
Figure 6B:
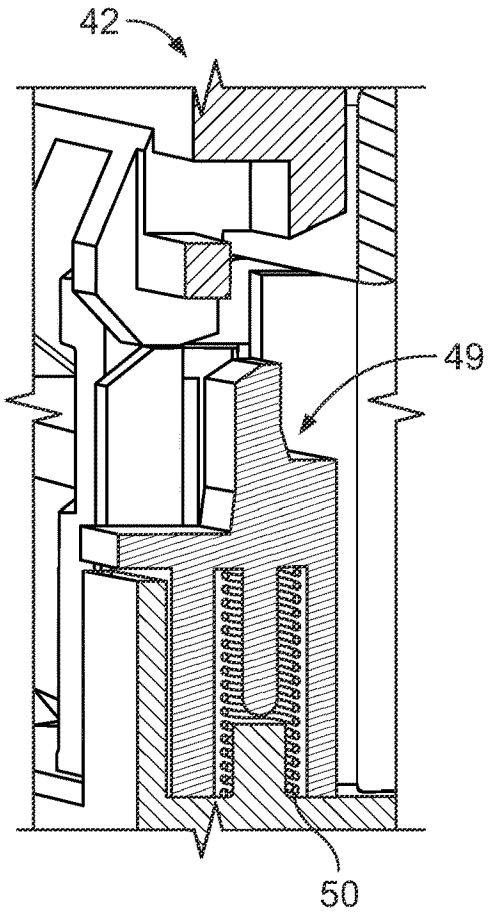
Figure 6A:
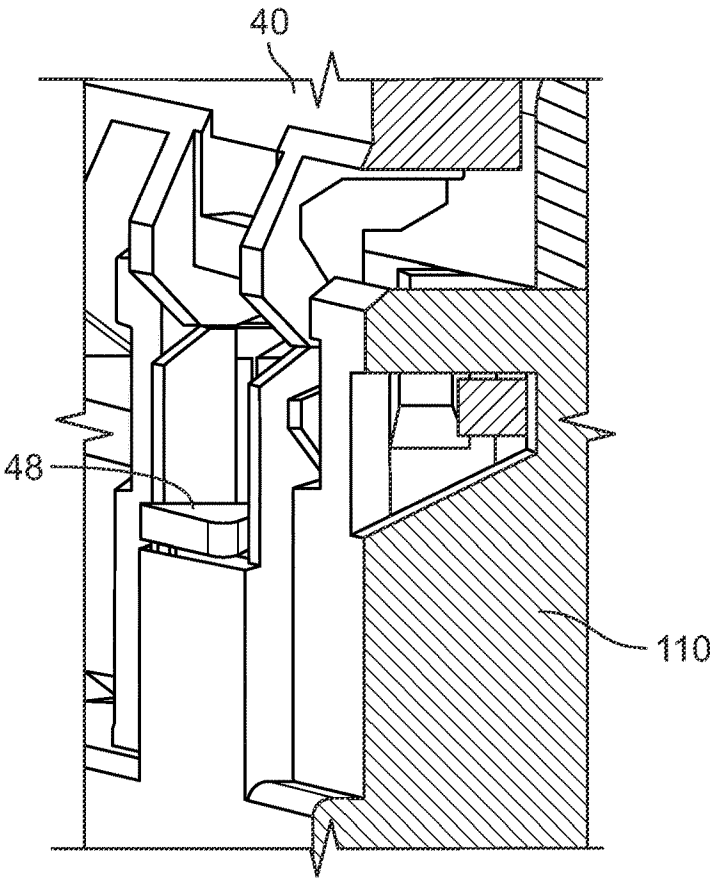
Figure 6D:
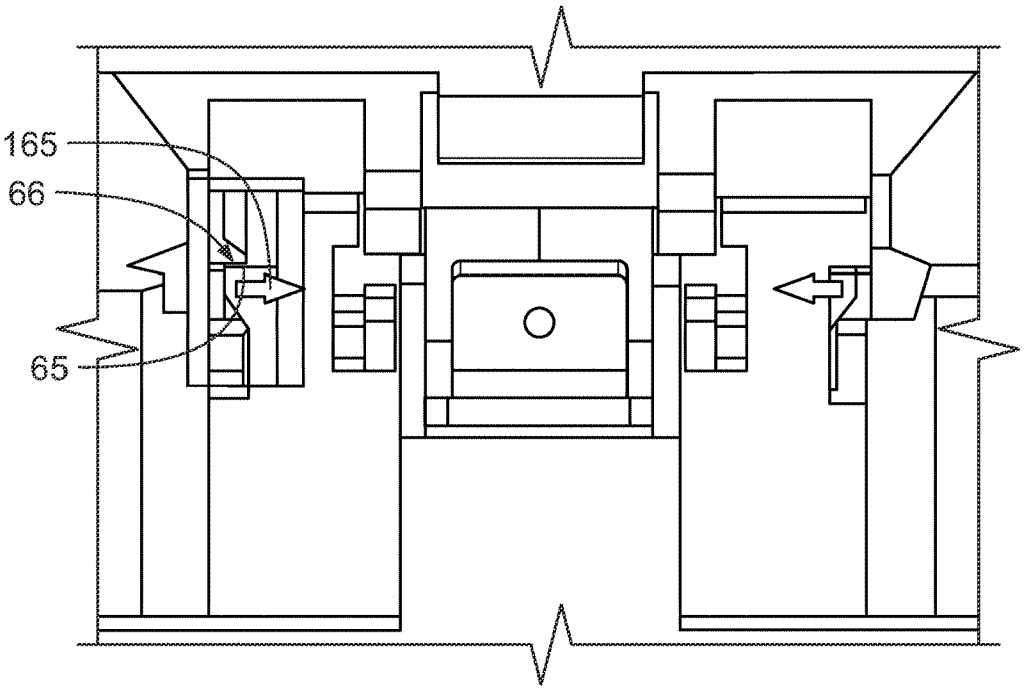
Figure 6E:
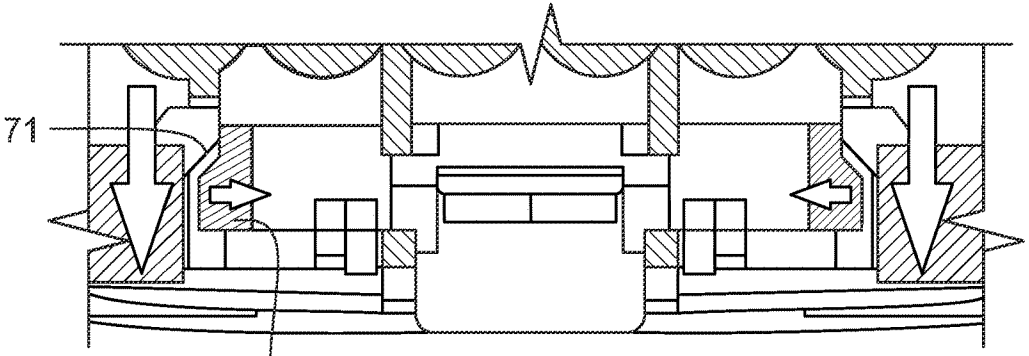
Figure 7D:
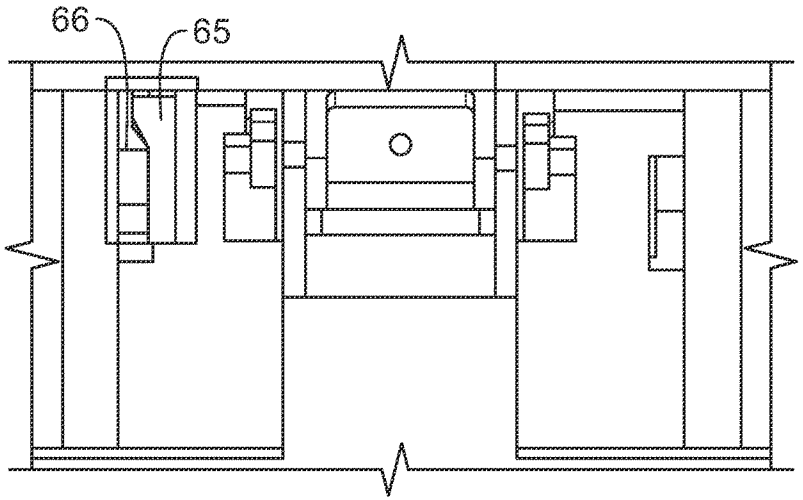
FIGS. 7A-7E show various schematic representations of the pre-latched position.
Figure 7E:
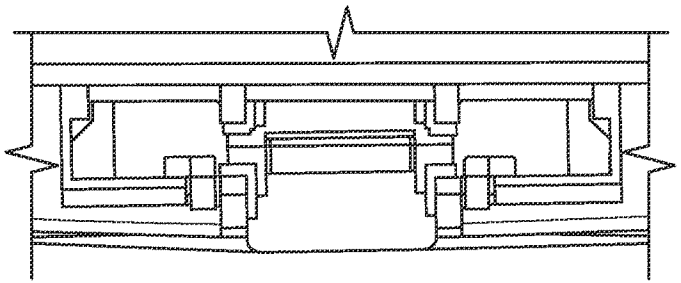
Figure 7B:
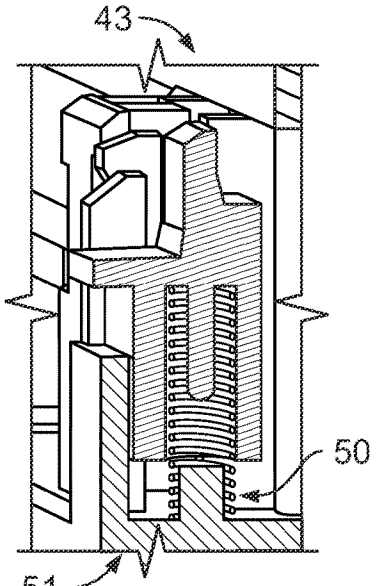
Figure 7A:
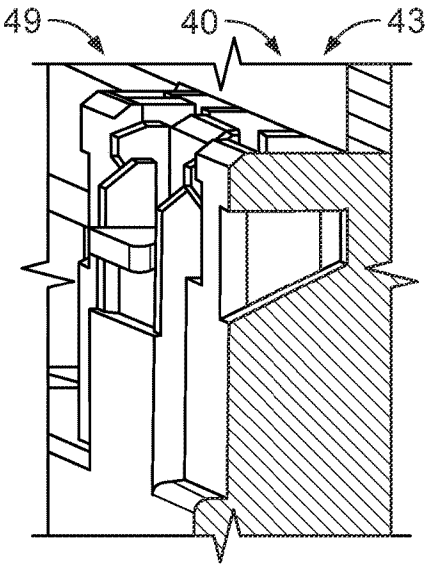
Figure 7C:
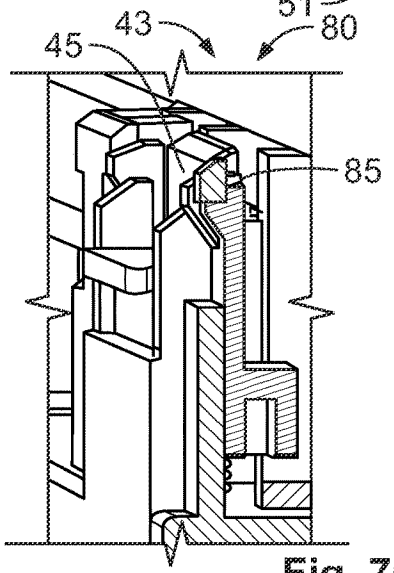
Figure 8C:
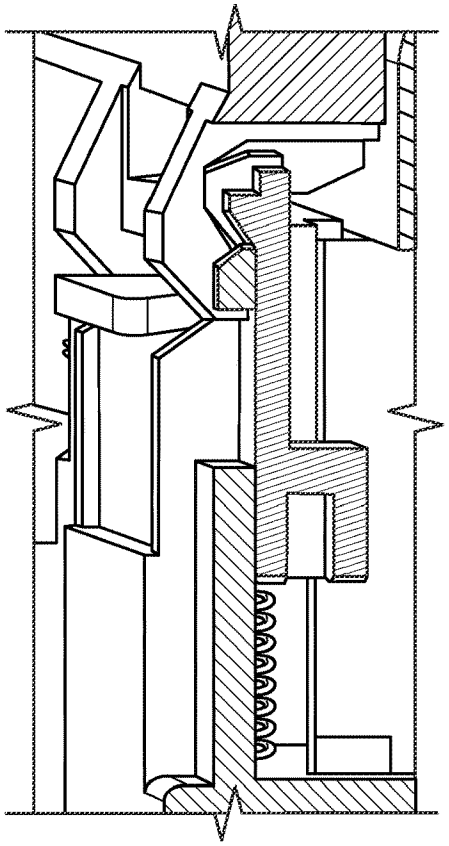
FIGS. 8A-8D show various schematic representations of the securing position.
Figure 8B:
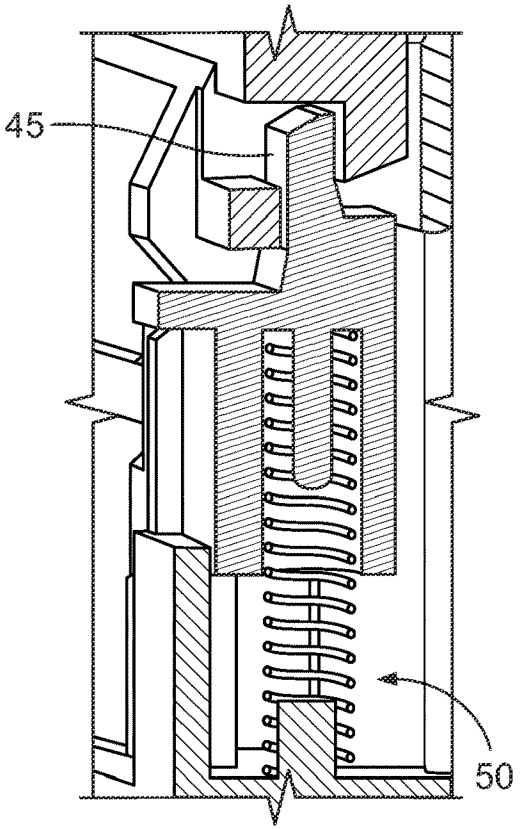
Figure 8A:
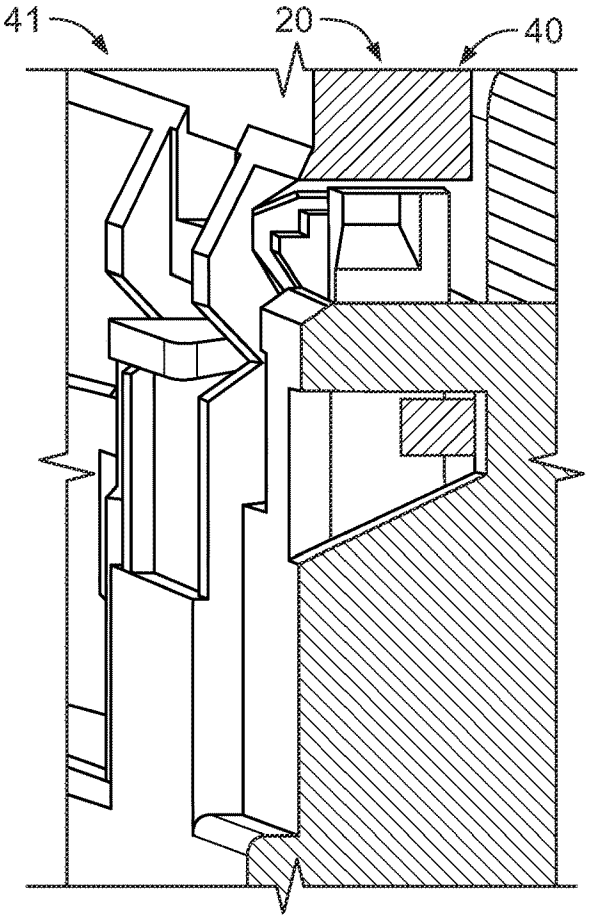
Figure 8D:
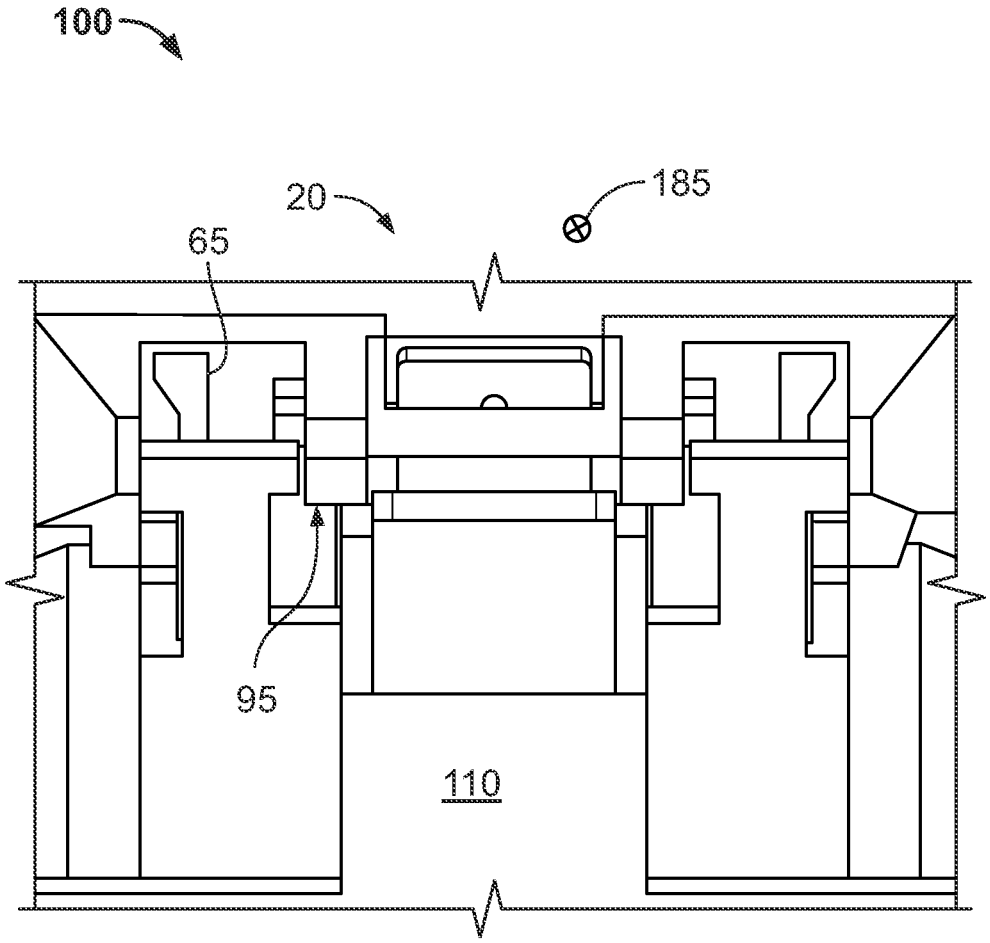

The mode of operation of locking mechanism 40 is shown in more detail in FIGS. 2, 3 and 4. FIGS. 5A to 8 D additionally show sections and further views in the different states.

In FIG. 2, locking mechanism 40 is in locking position 41 in which there is a positive fit engagement established between securing mechanism 20 and locking mechanism 40 along a direction of rotation of lever 25. A further locking mechanism 40 can also be seen on the left-hand side which comprises a simple latching element and is only briefly described below. This further locking mechanism 40 can be released by deflecting the latching element, where the latching element has to be held in the deflected state by the user in order to be able to throw lever 25. In previous locking mechanisms with a catch, it is also necessary to keep the catch in the deflected state, which is difficult, especially in combination with a further locking mechanism.

In the advantageous configuration shown on the right-hand side, such permanent holding, in particular of catch 49, by the user is not necessary. The user can latch locking mechanism 40, in particular catch 49, in holding position 42 shown in FIG. 3. A holding latch mechanism 60 secures locking mechanism 40 in holding position 42 when catch 49 is moved along direction of motion 149 which is parallel to the connection direction 160 of the connector to the mating connector, and there goes beyond a certain boundary. This boundary is defined by latching elements 65 of holding latch mechanism 60 which then snap into place on a mating element on housing 110. In the course of the motion, latching elements 65, which are arranged on a resiliently deflectable arm 120, are deflected in a deflection direction 165. The deflectable arm 120 has a free end 121. The deflection is facilitated by inclined surfaces 55. When latching elements 65 have passed respective mating latching elements, latching elements 65 spring back resiliently so that stop surfaces on the face side of latching element 65 abut against mating stop surfaces 66 on housing 110 and block a return motion.

In the holding position shown in FIG. 3, lever 25 can now be thrown since a volume that is swept over by lever 25, in particular by a stop surface 45 thereon, is released by locking mechanism 40, in particular by the corresponding stop surface 45 on catch 49. During this motion, deflecting elements 71, which are arranged on lever 25, deflect latching elements 65 of holding latch mechanism 60 so that they disengage from corresponding surfaces and elements on housing 110. Locking mechanism 40 is thereby released from holding position 42 and moves to pre-latched position 43 due to drive mechanism 50 comprising a spring element 21. In pre-latched position 43, the locking mechanism engages due to a pre-latch mechanism 80 since latching elements 85 of pre-latch mechanism 80 impact against corresponding mating elements on housing 110. In pre-latched position 43, a motion of securing mechanism 20, in particular lever 25, is possible without resistance from locking mechanism 40, since a motion path of lever 25 is released. In an embodiment, the holding latch mechanism 60 and the pre-latch mechanism 80 are part of a single latch assembly 140.

Locking mechanism 40 automatically passes from pre-latched position 43 to locking position 41 when securing mechanism 20 is moved to securing position 21, i.e. when lever 25 is rotated. Deflecting elements 95 of a pre-latch release mechanism 90 deflect latching elements 85 of the pre-latch mechanism 80 along a deflection direction 185. The block of drive mechanism 50 along direction of motion 149 is thereby released and drive mechanism 50 presses locking mechanism 40 along direction of force 150. Catch 49 thereby again enters into positive-fit engagement with securing mechanism 20.

Figure 9:
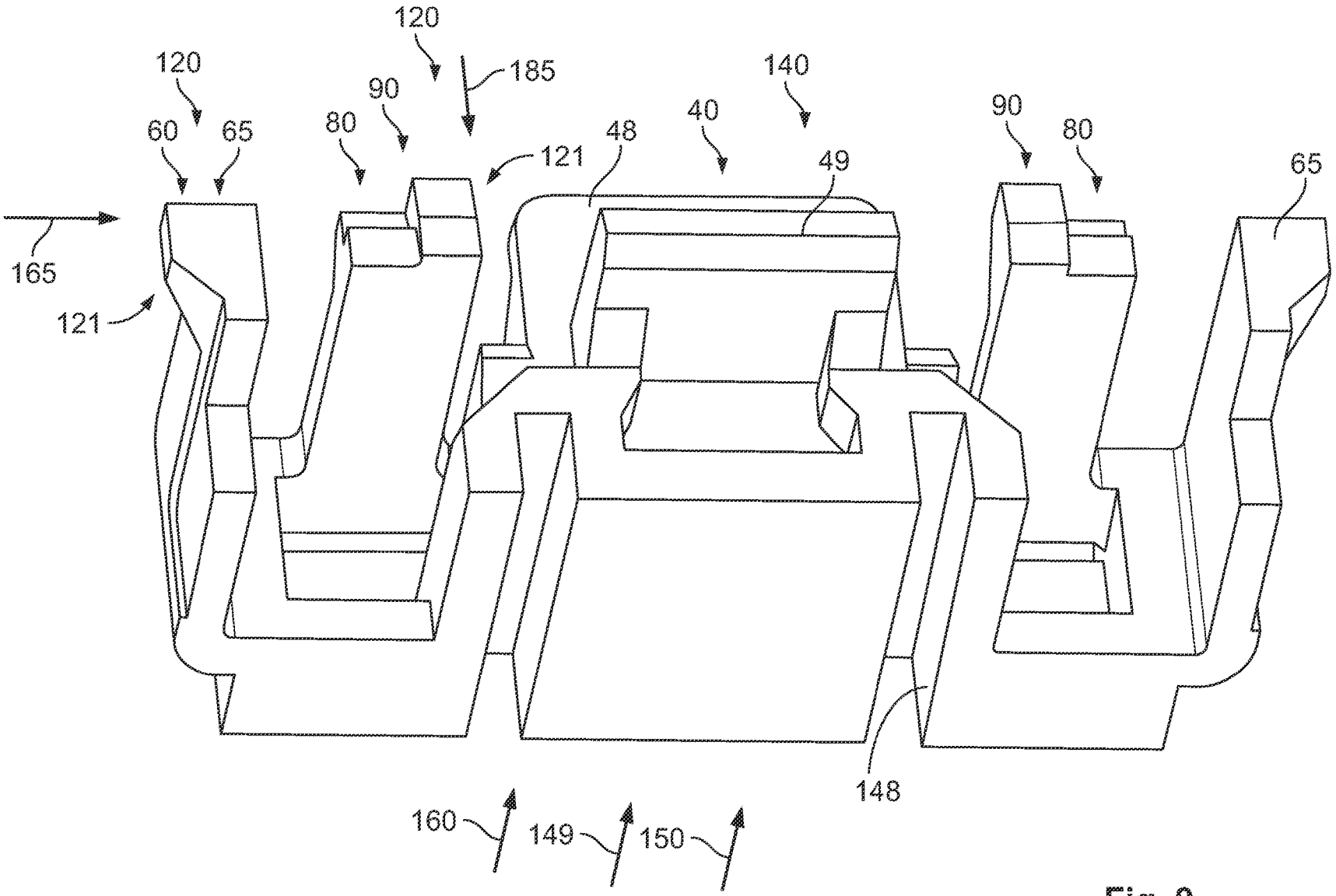
FIG. 9 is a schematic perspective view of the catch.
Figure 10:
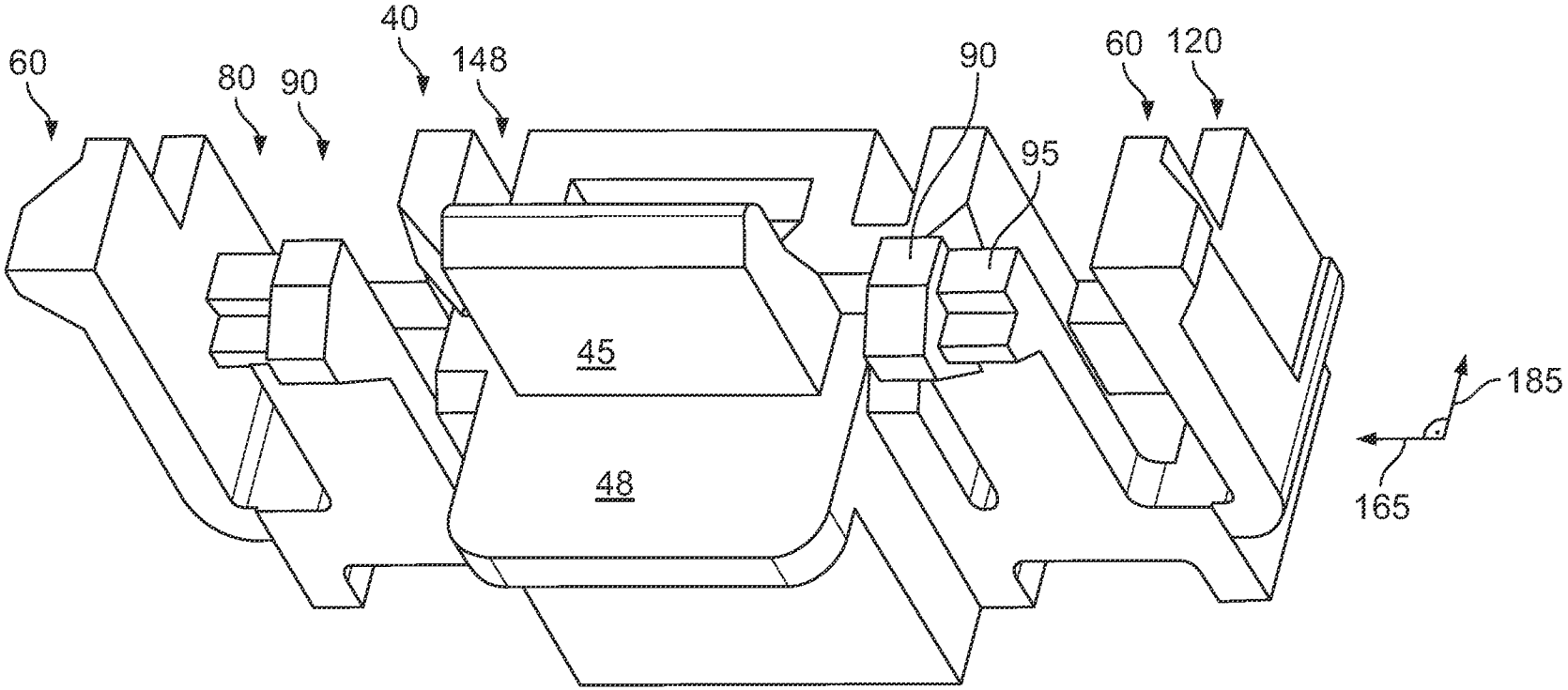
FIG. 10 is a schematic perspective view of the catch from a different perspective.

Catch 49 is shown in FIGS. 9 and 10 in two perspective views. It can be seen in particular that a deflection direction 165 of a latching element 65 of holding latch mechanism 60 is deflectable perpendicular to a deflection direction 185 of a latching element of pre-latch mechanism 80. This ensures safe operation.

Figure 11:
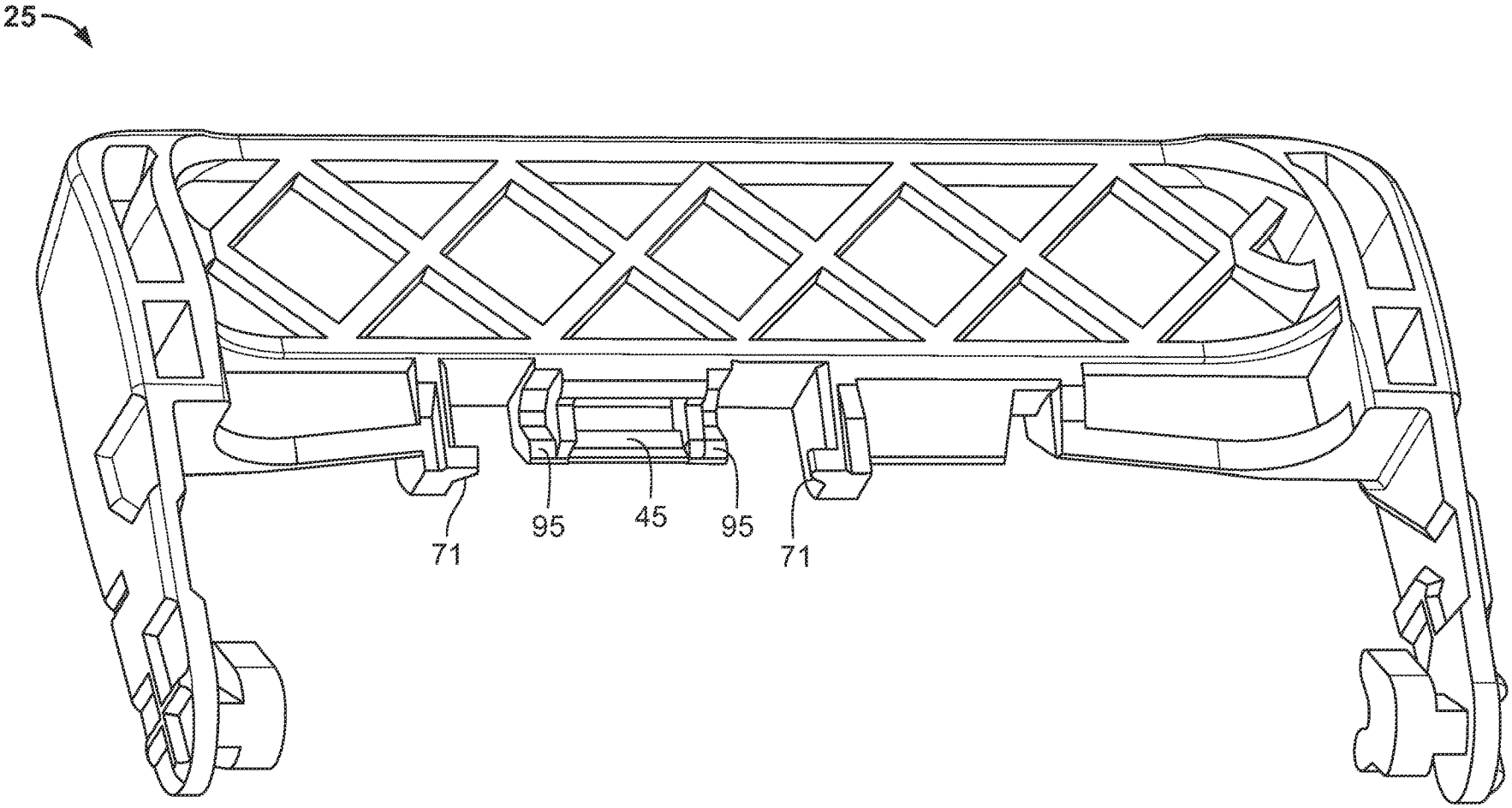
FIG. 11 is a schematic perspective view of the lever.
Figure 12:
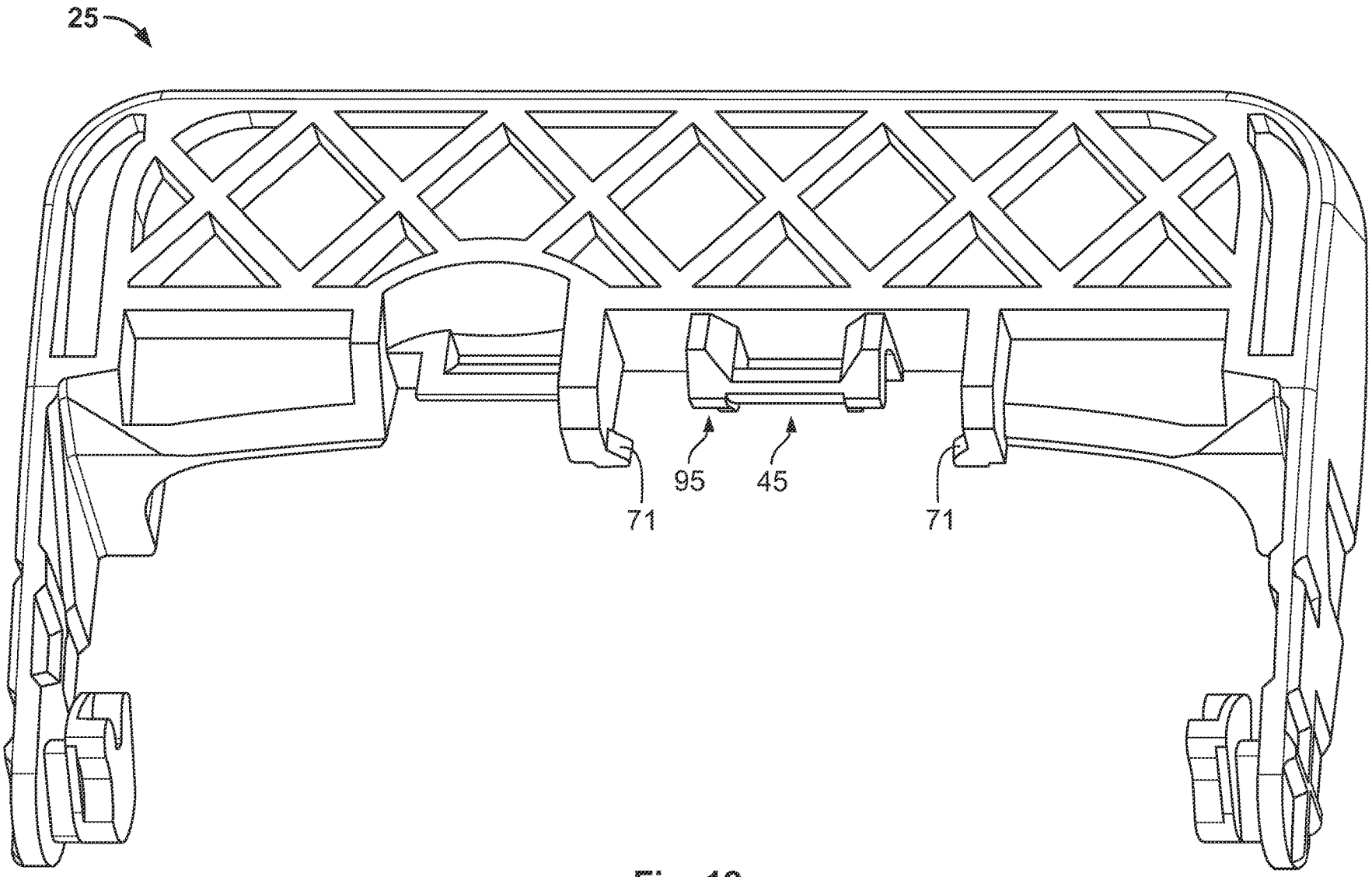
FIG. 12 is a schematic perspective view of the lever from a different perspective.

Catch 25 is shown in FIGS. 11 and 12 in two perspective views. Stop surface 45, with the aid of which lever 25 is locked in securing position 21, deflecting elements 71 of holding release mechanism 70, and deflecting elements 95 of pre-latch release mechanism 90 can be seen in particular.

It should be appreciated by those skilled in this art that the above embodiments are intended to be illustrative, and many modifications may be made to the above embodiments by those skilled in this art, and various structures described in various embodiments may be freely combined with each other without conflicting in configuration or principle.

Although the present disclosure have been described hereinbefore in detail with reference to the attached drawings, it should be appreciated that the disclosed embodiments in the attached drawings are intended to illustrate the preferred embodiments of the present disclosure by way of example, and should not be construed as limitation to the present disclosure.

Although several exemplary embodiments have been shown and described, it would be appreciated by those skilled in the art that various changes or modifications may be made to these embodiments without departing from the principles and spirit of the invention, the scope of which is defined by the claims and their equivalents.

It should be noted that, the word "comprise" doesn't exclude other elements or steps, and the word "a" or "an" doesn't exclude more than one. In addition, any reference numerals in the claims should not be interpreted as the limitation to the scope of the present disclosure.

What is claimed is:

1. A housing assembly for a connector, comprising:

a securing mechanism for securing the connector to a mating connector in a securing position;

a locking mechanism, the locking mechanism in a locking position locks the securing mechanism in the securing position, the locking mechanism is latchable in a holding position in which the securing mechanism can be moved out of the securing position, and the locking mechanism is latchable in a pre-latched position in which the securing mechanism can be moved to the securing position and where a pre-latch mechanism is configured to latch the locking mechanism in the pre-latched position;

a holding latch mechanism configured to latch the locking mechanism in the holding position;

a holding release mechanism configured to release the holding latch mechanism when the securing mechanism is moved out of the securing position; and a drive mechanism which generates a force that presses the locking mechanism out of either of the holding position and the pre-latched position.

2. The housing assembly according to claim 1, wherein the holding latch mechanism and the pre-latch mechanism are part of a single latch assembly.

3. The housing assembly according to claim 2, wherein the locking mechanism has a catch, and the locking mechanism is in the locking position, the holding position, or the pre-latched position depending on the position of the catch.

4. The housing assembly according to claim 3, wherein the catch is held in a linearly movable manner.

5. The housing assembly according to claim 4, wherein the locking mechanism passes from the holding position to the pre-latched position when the securing mechanism is moved out of the securing position.

6. The housing assembly according to claim 5, wherein the locking mechanism passes from the pre-latched position to the locking position when the securing mechanism reaches the securing position.

7. The housing assembly according to claim 6, wherein a latching element for the holding position and a latching element for the pre-latched position are deflectable perpendicular to one another.

8. The housing assembly according to claim 1, wherein the housing assembly has a further locking mechanism which locks the securing mechanism in the securing position.

9. The housing assembly according to claim 1, wherein the securing mechanism includes a rotatable lever.

10. The housing assembly according to claim 1, wherein the locking mechanism is released from the holding position and moves to the pre-latched position due to the force of the drive mechanism.

11. A housing assembly for a connector, comprising:

a securing mechanism for securing the connector to a mating connector in a securing position;

a locking mechanism, the locking mechanism in a locking position locks the securing mechanism in the securing position, the locking mechanism is latchable in a holding position in which the securing mechanism can be moved out of the securing position, and the locking mechanism is latchable in a pre-latched position in which the securing mechanism can be moved to the securing position; and a drive mechanism which generates a force that presses the locking mechanism out of either of the holding position and the pre-latched position.

* * * * *